United States Patent [19]

Wiggs et al.

[11] Patent Number: 4,570,868

[45] Date of Patent: Feb. 18, 1986

[54] DISPENSER FOR ADHESIVE LABELS

[76] Inventors: Christopher C. Wiggs, 64 Goldborough Crescent, Chingford, London; Christopher J. C. Taylor, 117 Latchmere Rd., London, both of England

[21] Appl. No.: 691,075

[22] Filed: Jan. 14, 1985

[30] Foreign Application Priority Data

Mar. 9, 1984 [GB] United Kingdom ..... 8406190

[51] Int. Cl.[4] ..... B65H 19/00

[52] U.S. Cl. ..... 242/55.53; 221/73

[58] Field of Search ..... 242/55.2, 55.53; 221/69, 70, 71, 73, 311, 22; 222/97–100; 156/361, 540–542

[56] References Cited

U.S. PATENT DOCUMENTS

| | | | |
|---|---|---|---|
| 3,066,881 | 12/1962 | Krueger | 242/55.53 |
| 3,321,105 | 5/1967 | Marano | 221/22 |
| 3,556,898 | 1/1971 | Allen | 221/73 X |
| 3,953,278 | 4/1976 | Smith et al. | 156/361 |
| 4,024,011 | 5/1977 | Crankshaw et al. | 156/542 X |
| 4,036,132 | 7/1977 | Ellefson | 221/73 X |
| 4,046,613 | 9/1977 | Kucheck et al. | 156/542 X |

*Primary Examiner*—Leonard D. Christian

*Attorney, Agent, or Firm*—John M. Cone

[57] ABSTRACT

A dispenser for pressure-sensitive adhesive labels on a web of release material in which a label-bearing web is withdrawn from a supply coil past a peel edge at which the direction of travel of the web reverses so that the labels separate from the web and advance towards the surface to be labelled, wherein the spent web is taken up by a take-up spool, and a friction roller rotatably mounted in the dispenser for contact with the surface to be labelled rotates as the dispenser is moved over the surface, the friction roller being operatively connected to the take-up spool so that both rotate at substantially the same surface speed and the labels are dispensed at substantially the same speed as the dispenser is moved but in the opposite direction.

10 Claims, 5 Drawing Figures

DISPENSER FOR ADHESIVE LABELS

FIELD OF THE INVENTION

This invention relates to a dispenser for adhesive labels of the kind in which the labels are provided on a strip or web of release material and the label-bearing web is withdrawn from a supply coil past a peel edge at which the direction of travel of the web reverses so that the labels separate from the web and advance towards a surface to be labelled.

BACKGROUND TO THE INVENTION

Label dispensers of the aforesaid kind are known, for example in the context of labelling of goods in supermarkets. But such labellers have employed large reels of pressure-sensitive adhesive labels and web, with the web being advanced by means of pinch rollers operated by means of a trigger mechanism, and with the spent web being discarded. This kind of dispenser has not been used with preprinted labels but has incorporated a printer to mark price or other information on each label as it is dispensed. It is an object of this invention to provide a label dispenser that is mechanically simple and is primarily intended to be used in association with strips of pre-printed labels. It is a further object of the invention to provide a dispenser in which the labels are discharged simply by moving the dispenser over the surface to be labelled.

SUMMARY OF THE INVENTION

Broadly stated the invention provides a dispenser for adhesive labels on a web of release material in which a label-bearing web is withdrawn from a supply coil past a peel edge at which the direction of travel of the web reverses so that the labels separate from the web and advance towards the surface to be labelled, wherein the spent web is taken up by a take-up spool, and a friction roller rotatably mounted in the dispenser for rolling contact with the surface to be labelled rotates as the dispenser is moved over the surface, the friction roller being operatively connected to the take-up spool so that both rotate at substantially the same surface speed whereby the labels are dispensed at substantially the same surface speed as the dispenser is moved but in the opposite direction.

With the above dispenser the labels are discharged simply by wiping the dispenser over the surface, and the labels do not move significantly relative to the surface as they are discharged.

DESCRIPTION OF PREFERRED FEATURES

Advantageously means in the dispenser defines a label discharge mouth that is in advance of the friction roller with reference to the intended direction of movement of the dispenser over the surface so that the friction roller passes over the discharged labels and adheres them to the surface.

Advantageously the dispenser is provided in a form comprising a case mounting the friction roller, drive means for the take-up spool and an access door leading to a space dimensioned to receive a removable cassette, said cassette comprising a body that enclosed the supply coil, peel edge and take-up spool. In such a dispenser the drive means may terminate in a splined capstan that engages in a complimentary bore in the take-up spool as the cassette is inserted into the body. Alternatively said drive means has a member formed with a bore into which a splined member projecting from the take-up spool is received. Rachet means may be fitted to inhibit reverse rotation of the take-up spool.

BRIEF DESCRIPTION OF DRAWINGS

An embodiment of the invention will now be described with reference to the accompanying drawings, in which.

DETAILED DESCRIPTION OF PREFERRED EMBODIMENT

Figure 1:
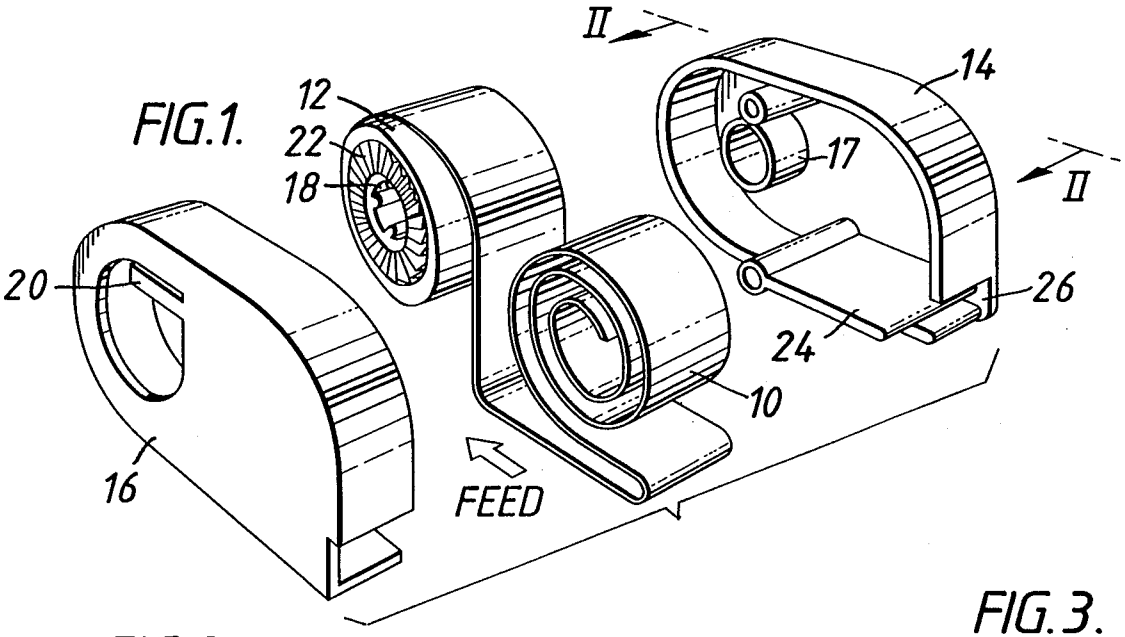
FIG. 1 is an exploded view and FIG. 2 is a side section of a cassette for a label dispenser.
Figure 3:
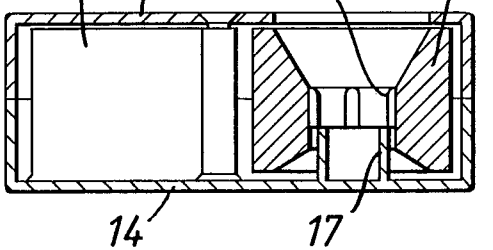
FIG. 3 is a view of the cassette in section on the line C—C of FIG. 2.
Figure 2:
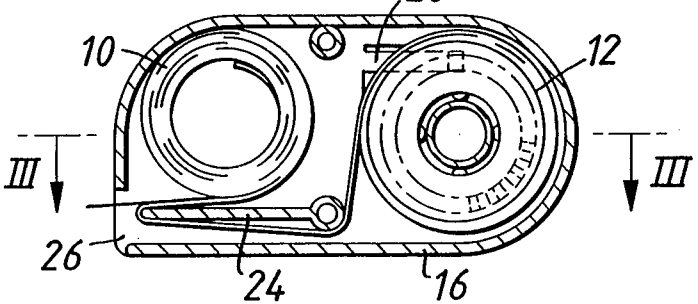

In FIGS. 1–3 a cassette for labels comprises a coil 10 of printed labels coated with a pressure-sensitive adhesive and held onto a backing web of release material, a take-up spool 12 and a housing formed in halves 14, 16. The blank half 14 is formed with a hollow spigot 17 that fits into a splined central bore 18 of the spool 12 and acts as a bearing axle. The other half 16 is formed with a rachet pawl 20 that cooperates with rachet teeth 22 disposed in a ring on the end of the spool 12 so that the spool 12 can only rotate in a label-dispensing direction. The half 16 is also formed with a guide plate 24 having a peel edge that guides the label-bearing web in a sharply angular path between the roll 10 and the take-up spool 12. Thus as the labels travel over the nose portion or peel edge of the plate 24 they become detached from the release backing and protrude through a dispensing opening 26.

Figure 4:
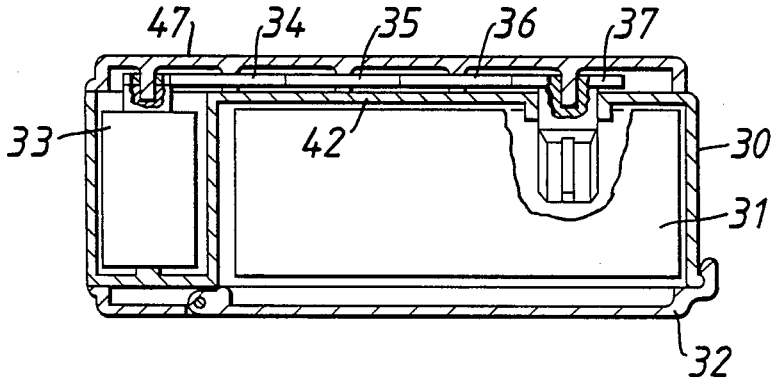
FIG. 4 is a view in horizontal section of a dispenser within which is fitted a cassette as shown in FIGS. 1–3.
Figure 5:
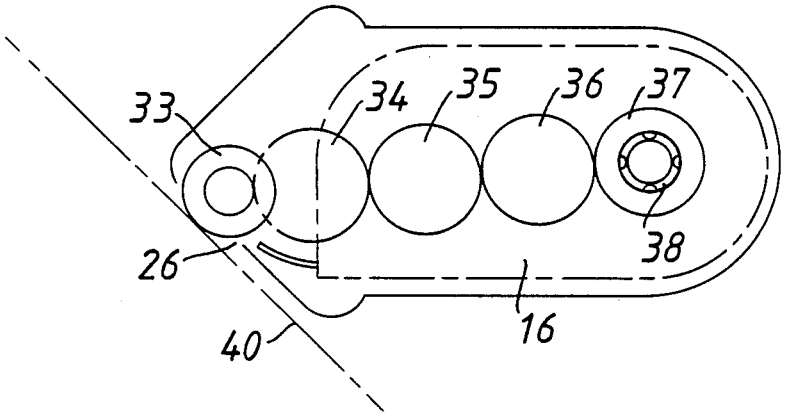
FIG. 5 is a diagrammatic side view of a label dispenser of the invention dispensing a label onto a surface.

Referring now to FIGS. 4 and 5 the cassette fits into a dispenser 30 provided with a space 31 for receiving a cassette. Access to the space can be gained by means of a hinged door access 32. The nose of the dispenser is provided with a pressure roller 33 that drives a train of four transmission gears 34–36 which are in edge to edge meshing relationship and drive output gear 37 that is provided with a splined drive formation 38 that fits into a region of the bore 18 not occupied by the spigot 17. Accordingly as the roller 33 which has a rubber-like outer surface is rotated by being drawn backwards towards the user, the rotation thereof is transmitted via gears 34–37 to the splined capstan 38 and so to the spool 12. Labels are dispensed as the capstan 38 rotates, and the relative speed ratio of the pressure roller 33 and the capstan 38 is chosen so that the label is dispensed at a range of speeds approximately synchronous with the speed at which the dispenser moves over the surface. It will be appreciated that the label speed will increase as the layer of spent web builds up on the take-up roller, but if the web is thin and not too long and the diameter of the take-up roller is large it may be arranged that the slight speed variation is not harmful in practice. The label is discharged in the opposite direction to that in which the dispenser moves and so has approximately zero speed relative to the surface. The label emerges through the opening 26 and through the body of the dispenser at an angle towards the surface 40 and the friction roller 33 then rolls over it. As the label is coated with a pressure-sensitive adhesive on its underside, the pressure of the roller 33 causes it to be bonded to the surface. If at this point a different cassette is to be used, the door 32 is opened, the cassette falls out and a new cassette can be inserted.

The described apparatus has the advantage that there is not need to thread, feed or reel up the labels or webs as this is done already inside the cassette. When all the labels have been used up and the web shows, the cassette can simply be thrown away. However, the cassette may be made re-usable if required.

The invention is not limited to the embodiment described above, the modifications may be made without departing from the invention, the scope of which is defined in the appended claims. For example, the web path in FIG. 2 may be straight from the guide plate 24 to the take-up spool 10 which is caused to revolve in the opposite direction from that shown by adding a further transmission gear to the train. This arrangement avoids the need for the web to be deflected through 90 degrees as it leaves the guide plate, and lowers the frictional resistance to operation.

We claim:

1. A device for dispensing labels comprising:

means for storing a web of release material carrying labels;

a take-up spool to which said web is transferred during use of the device and on which said web is stored after removal of the labels from the web;

a peel edge about which said label-carrying web is constrained to make a reversal of its direction of travel while passing from said store means to said take-up spool to separate a label from said web;

a friction roller rotatably mounted in said device and adapted to contact a surface on which said label is to be dispensed and to be rotated as said device is moved across said surface with said roller in contact therewith;

drive means interconnecting said friction roller and said take-up spool whereby rotation of the friction roller rotates the take-up spool at substantially the same surface speed so that the labels are dispensed at substantially the same speed as the device is moved.

2. A device according to claim 1, wherein:

the friction roller is located adjacent a label-discharge mouth of the device and to the rear side of the mouth with reference to the intended direction of movement thereof, and wherein said labels are dispensed in a direction opposite to the direction of movement of the device across such surface so that the friction roller contacts each discharged label and presses it onto the surface after it is dispensed through said mouth.

3. A device according to claim 1, wherein: said drive means includes a gear train.

4. A device according to claim 1, wherein: said drive means includes a toothed belt.

5. A device according to claim 1, comprising:

a housing of the device, said housing mounting the friction roller; and an access door in said housing which when open gives access to a space dimensioned to receive a cassette, said cassette comprising a body that encloses the store means, peel edge and take-up spool.

6. A device according to claim 5, wherein the drive means includes:

a splined capstan which engages in a complimentary bore in the take-up spool.

7. A device according to claim 5 wherein:

said device means has a member formed with a bore into which a splined member projecting from the take-up spool is received.

8. A dispenser according to claim 1 or claim 5, further comprising:

ratchet means arranged to inhibit reverse rotation of the take-up spool.

9. A hand-held device for applying pressure-sensitive labels to a surface, comprising:

a body having an opening through which said labels are dispensed;

a roller carried by the body and adapted to be driven in rotation by movement of the device in contact with said surface;

a supply of web material in said body;

pressure-sensitive labels releasably disposed along said web;

a take-up spool receiving said web after removal of said labels;

a peel edge located adjacent said opening about which edge said web is constrained to suffer a change of direction in its travel before reaching the take-up spool, which change of direction separates the label from the web;

drive means interconnecting said roller and said take-up spool to drive said spool in rotation at substantially the same speed as the roller is rotated whereby the label is discharged through said opening at substantially the same speed as the device is moved over said surface.

10. A hand-held device for applying pressure-sensitive labels to a surface comprising:

a housing;

a door in said housing;

a cassette insertable into said housing through said door;

said cassette comprising:

a coil of web material carrying releasable labels;

a take-up spool on which said web is stored after removal of the labels therefrom;

a peel edge about which said web suffers a change of direction of travel prior to reaching said take-up spool to detach said labels from said web;

a friction roller carried by said body and engageable with said surface;

means drivingly connecting said roller to said take-up spool whereby rotation of the roller as the device is moved over said surface causes rotation of said take-up spool and movement of said web and discharge of a label onto said surface at substantially the same speed as the speed of movement of said device.

* * * * *